US005577736A

United States Patent [19]

Arabo

[11] Patent Number: 5,577,736

[45] Date of Patent: Nov. 26, 1996

[54] ENTERTAINMENT GAME UTILIZING ELECTRICALLY POWERED CARS

[76] Inventor: Emile D. Arabo, 21845 Tuller Ct., Southfield, Mich. 48076

[21] Appl. No.: 206,117

[22] Filed: Mar. 4, 1994

[51] Int. Cl.[6] ..... A63B 67/00; B60L 9/00

[52] U.S. Cl. ..... 273/442; 180/2.1

[58] Field of Search ..... 472/10; 180/2.1, 180/7.1; 273/442

[56] References Cited

U.S. PATENT DOCUMENTS

| | | | |
|---|---|---|---|
| 1,380,759 | 6/1921 | Whitaker, Jr. | 293/107 |
| 1,544,978 | 4/1925 | Waltoff et al. | 180/2 |
| 1,669,104 | 5/1928 | Stock | 180/2 |
| 1,779,052 | 10/1930 | Souplis | 191/13 |
| 2,165,743 | 7/1939 | Bland | 180/2 |
| 3,339,653 | 9/1967 | Chaplenko | 180/2 |
| 3,978,934 | 9/1976 | Schneidinger | 180/2 |
| 4,237,990 | 12/1980 | La | 180/7 R |
| 4,324,301 | 4/1982 | Eyerly | 180/2 R |
| 4,476,949 | 10/1984 | Patton | 180/65.1 |
| 4,484,646 | 11/1984 | Smith | 180/6.2 |
| 4,715,460 | 12/1987 | Smith | 180/7.1 |
| 4,898,382 | 2/1990 | Lamanna | 273/1 GC |
| 4,920,890 | 5/1990 | Barber | 104/53 |
| 4,991,835 | 2/1991 | Lamanna | 273/1 GC |
| 5,016,540 | 5/1991 | Barber | 104/53 |
| 5,100,155 | 3/1992 | Lamanna | 273/442 |

*Primary Examiner*—Jessica J. Harrison
*Attorney, Agent, or Firm*—Weintraub, DuRoss & Brady

[57] ABSTRACT

A team game utilizing electrically powered cars and a pair of targets has an electrified floor to supply power to the cars. Two teams of players attempt to score as many points as possible. Each player drives one car around the floor area, positioning themselves in range to shoot at a multiple holed target or goal. The cars are capable of precise movement due to the joystick control and processor connected thereto, and the control it has over the movement of a hydrostatic transmission. This gives the car a movement controllable as to speed and direction, including the ability to stop and reverse directions without repositioning of the vehicle.

9 Claims, 3 Drawing Sheets

FIG 2
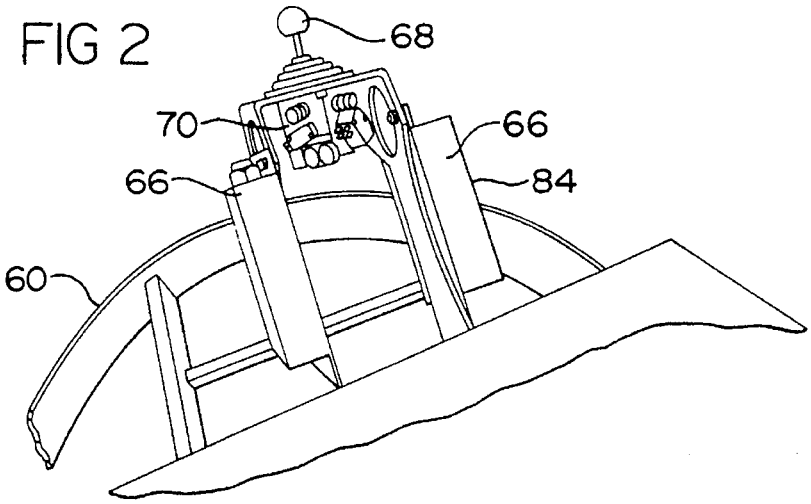
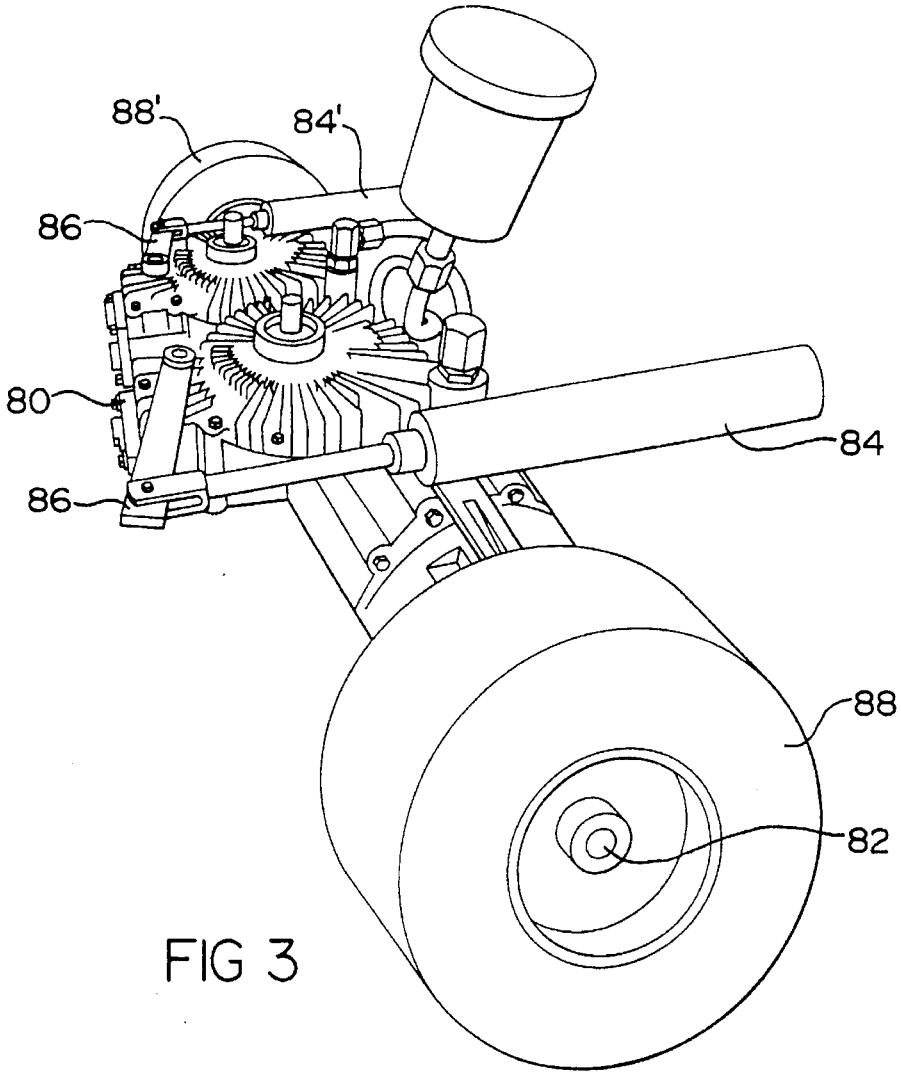
FIG 3

FIG 6
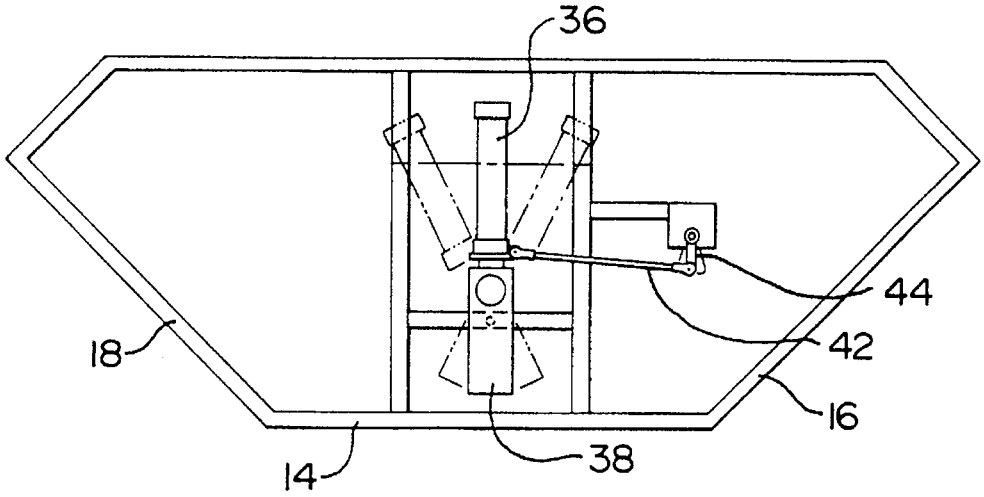
FIG 5
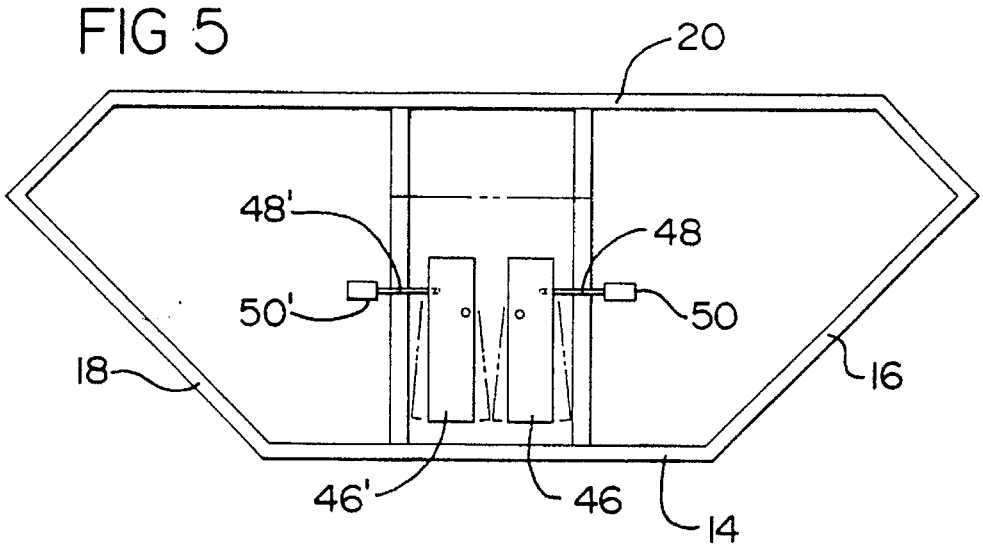
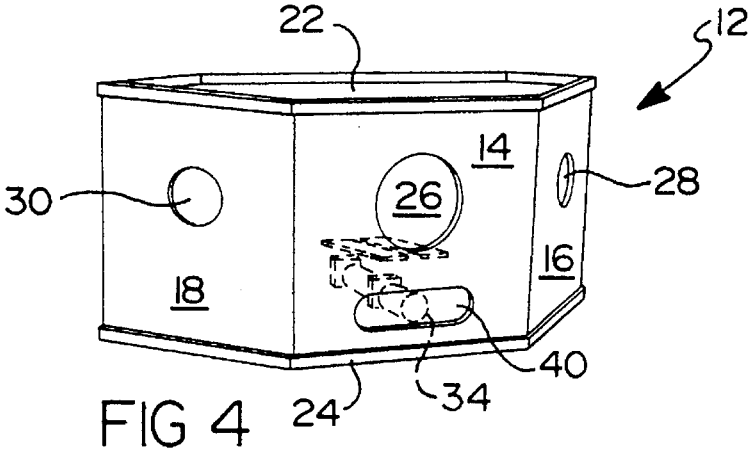
FIG 4

ENTERTAINMENT GAME UTILIZING ELECTRICALLY POWERED CARS

BACKGROUND OF THE INVENTION

1. Field of the Invention

The present invention concerns a recreational game. More particularly, the present invention concerns a recreational game played by teams of players attempting to shoot a ball into an assigned goal while piloting electrically powered cars.

2. Prior Art

The use of recreational vehicles for entertainment and sport has been known for many years. One particularly familiar motorized recreational activity is the bumper car ride seen at carnivals and amusement parks. The cars are powered through an electrified floor of alternating current. The floor comprises a plurality of panels which supply power, each panel being either positive or negative in polarity. Panels are alternately disposed across the floor between positive and negative polarity, such that a first panel has a positive polarity and a second panel deployed adjacent to the first panel, has a negative polarity. Panels of one polarity are never disposed adjacent another panel of the same polarity. Receptors in the car draw the current from the floor panels, where a rectifier/transformer places the alternating current into direct current for a motor to produce the power necessary to propel the car.

The car moves only forwardly, rearward travel being impossible. The car cannot stop precisely, but rather must coast to a halt when power is withdrawn and inertia has its effect. Steering is accomplished through a crank, often having a wheel attached thereto, which orientates the wheels or bearings mounted to the chassis of the car. This affords sluggish response to changes in direction, making car control imprecise.

The bumper car amusements, in which such cars are utilized, consists of multiple drivers attempting to hit one another with their vehicles. More involved versions of this game have been devised, one example being set forth in U.S. Pat. Nos. 4,991,835, 4,898,382 and 5,100,155, all issued to Lamanna. The Lamanna references teach a game utilizing specially designed bumper cars. Each car has depressible forward and rearward bumpers. The depressing of a bumper will either increase or decrease the score of a player, depending upon which bumper is depressed. The movement of either bumper activates a sensor, which in turn causes a signal to be transmitted from the car to a receiver mounted in the roof or ceiling of the playing area. From this, a centralized scoring system is kept. Each car has a display for its driver's score, providing easy reference during the game.

While providing an improved means for displaying and managing scores, the game apparatus of Lamanna does not provide an improved car for heightened enjoyment of the game by greater control of the car. Further, Lamanna involves play on an individual basis, not on a team basis. Inasmuch as Lamanna is directed toward a game that involves the driving of cars into each other, the game set forth therein would not even suggest improvements to the bumper car regarding improving vehicle maneuvering.

One gaming system that is known, though for which no patent protection is believed to have been sought, is the Whirlyball game. Whirlyball involves two teams of players, usually five per team, who cooperate to score as many points as possible in a set time period. Each team has an assigned "goal" or target at which to shoot a plastic ball. Each player has a scoop with which to collect the ball, shoot it at the goal, or pass it to teammates. The goal comprises a backboard, similar to that used in basketball, with a hole formed centrally therein. A team scores two points for shooting the ball into the hole. A sensing mechanism, comprising a pivotal webbed sheet, is stationed behind the hole. When the ball passes through the hole, the sheet of the mechanism is moved, and bells and lights are set off, indicating the scoring of the goal. The accounting of score is handled by a scorekeeper, who also acts as the referee and game announcer.

The Whirlyball system offers an improved version of a team game in an electric car format. However, the cars used in Whirlyball are substantially similar to those used for decades in the bumper car art. Thus, these cars cannot be maneuvered or stopped precisely. This makes car control difficult, affecting the play of the game and reducing the enjoyment of the game.

What is needed is an improved car to increase control during the playing of a team game. Further, what is needed is an improved team game to best utilize this improved electric car and thus produce a more enjoyable team game. It is to these needs and to solving the problems present in the art that the present invention is directed.

SUMMARY OF THE INVENTION

The present invention is a gaming apparatus for team competition. The apparatus comprises:

(a) a plurality of electrically powered cars, each car comprising:

(1) a chassis;

(2) a frame mounted upon the chassis;

(3) a means for drawing electrical power into the car;

(4) an electrical motor connected to the means for drawing electrical power;

(5) a joystick mounted upon the frame to direct the car;

(6) a control unit mounted upon the frame to receive electrical impulses from the joystick;

(7) at least two wheels;

(8) a hydrostatic drive connected to the frame, the wheels being mounted within the drive;

(9) means for positioning the wheels of the car in response to the control unit;

(b) a plurality of goals, each goal comprising:

(1) a plurality of panels, each panel having at least one hole formed therein;

(2) means for sensing a ball entering a hole formed in a panel; and (3) means for returning the ball into play;

wherein two teams, each having a plurality of players, attempt to score points by placing the ball through one of the holes in the panels of the goal while moving around in the cars.

The present invention includes, in the preferred embodiment, the use of a joystick and a control unit in combination to govern the direction and movement of the car. Further, actuators, under the direction of the control unit, affect the action of a hydrostatic drive. The car is propelled by an electrical motor. The car is further covered by a body made of fiberglass or similarly durable substance.

The present invention will be more clearly understood with reference to the accompanying drawings, in which like reference numerals refer to like parts, in which:

BRIEF DESCRIPTION OF THE DRAWINGS

FIG. 2 is a rear view of the joystick control of the bumper car of the present invention;

FIG. 3 is a perspective view of the transaxle portion of the bumper car of the present invention.

FIG. 4 is a perspective view of the goal of the present invention, where the firing canon is shown in phantom;

FIG. 5 is a top cross-sectional view of the goal of the present invention; and FIG. 6 is a bottom cross-sectional view of the goal of the present invention.

DETAILED DESCRIPTION OF THE PREFERRED EMBODIMENTS

Figure 1:
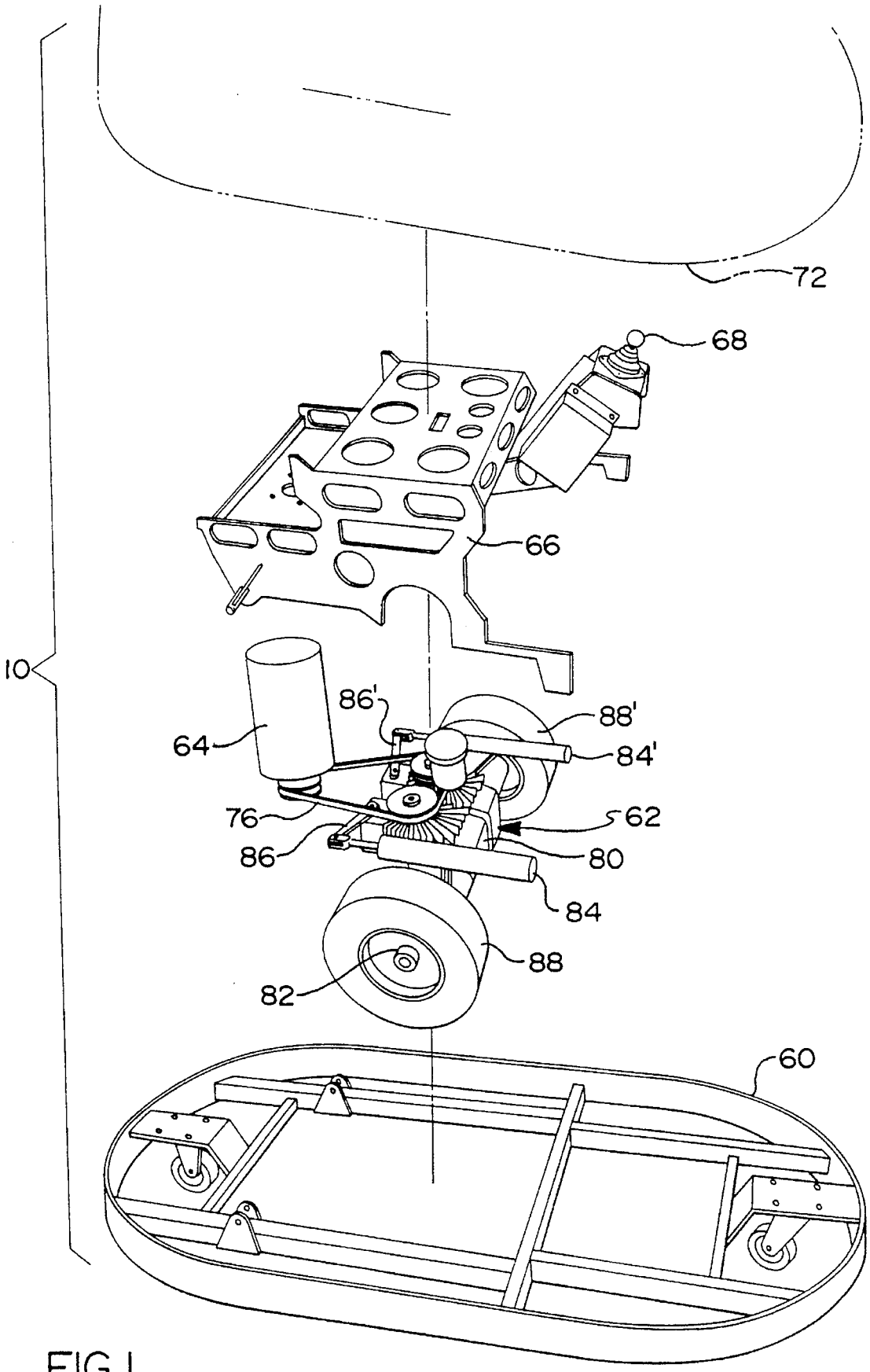
FIG. 1 is an exploded view of the bumper car of the present invention.

Referring now to FIGS. 1–6, there is shown therein the present invention, to wit, a gaming system comprising a plurality of electrically powered cars 10 and a plurality of goals 12. To better describe the environment in which the gaming system is utilized, a description of the game of the present invention will first be set forth.

The game of the present invention involves competition between two teams, each having between three and six players on each side. The players all are situated in an electrically powered car 10. The cars 10 and players are deployed in an area suitable for this activity (not shown). This playing area is substantially rectangular in shape. The length of the area is ideally between eighty feet and one hundred feet, while the width is between thirty-five feet and fifty feet. The ceiling is approximately fifteen to twenty feet from the ground. Of course, these dimensions may be altered to suit space limitations of a particular building without drastically affecting the playability of the game.

Each team cooperates among its members to score the most points possible. Points are scored or deducted in one of two ways: making a goal or incurring a penalty. Penalties can include handling of the ball, striking a player with a scoop, etc. The more severe a penalty, the more penalty points deducted from the score of the infringed party. Clearly, a team attempts to avoid making penalties, and thus minimize the points lost.

Each team shoots at a designated goal. Shooting is accomplished by the use of scoops (not shown), similar to those produced by the Wham-O Corp. under the trade name "Trakball". Alternately, shooting could be accomplished by holding and throwing the ball with the hand of a player. This method of shooting is less preferred, however, due to the highly increased possibility of player injury by the sandwiching of the player's hand between two cars, one car and a side wall, etc. Thus, for safety reasons and for the added skill dimension, scoops are preferred for shooting and ball handling in this game.

The ball used in the play of the game is preferably formed of a lightweight and resilient plastic. Such balls are commonly available in the market and are referred to as "Wiffle-balls". Balls of greater weight are less preferred for use, as they increase the possibility of player injury from inadvertent contact from the ball. Also, such balls impart more force upon the playing equipment, particularly the goals. Thus, wear upon the goals and potential damage thereof is reduced by utilizing plastic balls. As will be discussed herein further below, the use of lightweight plastic facilitates the use of the cannon or other means for returning the ball to play.

The goal 12, as shown in FIGS. 4–6, comprises a substantially trapezoidal box. The goal 12 has a front panel 14, a right panel 16 and a left panel 18. The panels 14, 16 and 18 are mounted to a frame 20. The frame 20 acts as a skeleton, suppling structural strength to the goal 12. The frame 20 can be attached to one wall of the playing area (not shown), as by bolted brackets and other similar known means. A top 22 and a bottom 24 enclose the goal 12, so as to, in part, shield the mechanical parts of the goal 12 from dirt and dust, as well as errant shots.

The front panel 14 has a target hole 26 formed therein. The target hole 26 has a certain diameter, generally ten to fourteen inches. The right panel 16 and the left panel 18 also have target holes 28, 30 formed therein. The target holes 28, 30 are substantially equal in size, having a diameter of between six and ten inches. Since the target holes 28, 30 are smaller in diameter than the target hole 26 of the front panel 14, a team gains more points for making a score into either side panel 16, 18 than if a score is made shooting into the front panel 14. This adds a level of skill and strategy not heretofore found in gaming apparatus or systems of this type.

When a goal is scored into any of the target holes 26, 28, 30, a sensing device 31, such as a photoelectric cell, is triggered. This automatically increases the tally of the scoring team and sets off visible and audible signals to indicate the scoring, such as by flashing lights and bells. The flashing lights, as envisioned, would include one color light for a score made in the first panel 14, such as green, and a second color for a score made in the side panels 16, 18, such as red. This would clearly denote a higher number of points achieved for making a score in the side holes 28, 30.

The ball is then directed by appropriate means, such as by tubing or tracks, and is loaded into means 32 for returning the ball to play. The means 32 for returning, as depicted in FIGS. 5–7, comprises a pneumatic cannon 34 pivotally mounted to the frame 20. The cannon 34 comprises a barrel 36 and a propulsion source 38. The source 38 drives forwardly in the barrel 36 a plunger (not shown) which drives the ball forwardly. Before firing, a door 40 located in the front panel 14 is opened to allow the launching of the ball. The use of a lightweight plastic, thus, facilitates the launching, as a less powerful cannon can be used.

A first end of the shaft 42 is attached to the barrel 36 of the cannon 34. The second end of the shaft 42 is attached to a swiveling member 44. The member 44 moves in a pendulum-like motion. This effects the swiveling of the cannon 34, such that the trajectory of the ball when fired may be along an arcuate path or position.

To facilitate the loading of the ball into the cannon 34, a pair of flat members 46, 46' are pivotally mounted behind the front panel 14 of the goal 12. A pair of rods 48, 48' are connected to the flat members 46, 46', the rods extending from magnetic solenoids 50, 50'. The solenoids 50, 50' cause the rods 48, 48' to be extended and withdrawn. This causes the flat members 46, 46' to be pivoted, such that the ball may descend off the flat members 46, 46' at an area only near the back of the goal 12 to fall out therefrom. The flat members 46, 46' are also somewhat inclined, such that these members cause the ball placed thereupon to gravitate towards the rear, where it may be lowered into the cannon 34 for firing.

In an alternate embodiment, the means 32 for returning may comprise a pair of rotating wheels (not shown) and a track or tube behind the wheels. The operation of this alternate means for returning is similar to that of baseball pitching machines, which are well known. One wheel rotates in a counter-clockwise direction. The other wheel rotates in a clockwise direction. The ball is deposited upon the track, which is disposed at an incline relative to the rotating wheels. The ball rolls by force of gravity toward the wheels. The wheels impart force upon the ball, causing it to be hurled forward through the previously opened door of the front panel.

Having now set forth the game parameters and rules and having given a detailed description of the goals to be shot at by the players, attention is now turned to FIGS. 1–3 to examine the improved bumper car 10 of the present invention. The bumper car 10 comprises a chassis 60, a transaxle 62, an electric motor 64, a frame 66, a joystick 68, a control unit 70 and a body 72.

The car 10 is deployed on an electrified floor (not shown), which is known in the art. The floor comprises a plurality of panels. The panels are arranged so that the panels alternate in polarity. That is, one panel has a positive polarity and the next panel has a negative polarity, followed by a positive polarity panel. An insulation strip is disposed between each panel to prevent a complete circuit from being made between two adjacent panels. At no time are two panels of like polarity laid adjacent each other. The floor is preferably made from stainless steel, which is a cleaner surface than the more common flooring, which utilizes carbonized steel. Stainless steel avoids the mess and odor associated with more common flooring.

To effect the absorption of current from the floor, the frame 66 has a plurality of contacts 74, 74' formed thereon to make electrical contact with the flooring. The contacts 74 are spaced out carefully, such that at least one contact touches a negative panel and at least one contact touches a positive panel. Ideally, there are four contacts disposed equally spaced in quadrants amid the chassis. Specifically, one is near the left front area of the chassis, one in the right front area, one in the left rear area and one in the right rear. This makes a complete circuit and the proper flow of current to be fed to the car 10.

The game of the present invention is envisioned as being adaptable to the abilities of the players. For example, children would not be able to handle the cars at higher speeds. Conversely, the enjoyment of play for advanced adult players would be lessened if the speed of the cars were too slow. Therefore, the present invention envisions a voltage level in the floor which can be varied. The range of voltages can be from twenty-one volts to fifty-six volts, with the preferred voltage range being between thirty-two volts and forty-eight volts.

Each contact 74 is connected to circuitry (not shown) comprising a pair of oppositely poled diodes. Each diode is connected to circuitry which directs the current to either a positive line or negative line. The diodes act to prevent shorting in the power intake to the car 10.

The current is then, in part, fed to a power rectifier (not shown). The power rectifier accomplishes the conversion of the current from alternating current to direct current. The current is also directed, in part, to a transformer (not shown). The current leaving the transformer is set at a level of twelve volts, such that the joystick and control unit will not be overloaded.

The direct current is also fed to an electrical motor 64. The motor 64 produces rotational force, which is transmitted by a belt 76 to the transaxle 62. The electrical motor 64 may be selected from among those widely available on the market, one preferred example being that produced by the Ohio Electric Company of Barnardsville, N.C.

The transaxle 62 comprises a hydrostatic drive 80, a pair of independent axles 82, 82' and a pair of actuating cylinders or actuators 84, 84', each actuator 84, 84' having a clevis end 85, 85'. Alternately, the clevis ends 85, 85' may be replaced with rod ends, if desired. The hydrostatic drive 80 comprises two independent hydrostatic transmissions, each having a hydraulic motor and a pump (not shown). Each pump is controlled by a tilting swashplate, which are joined to the extending members 86, 86' respectively. These members 86, 86' are fastened to the clevis ends 85, 85' of the actuators 84, 84'. By the motion of the actuators 84, 84', and therefore the extended members 86, 86', the transaxle 62 is altered in operation.

By the movement of the tilting swashplate, the pump inside the transmission is altered in its speed of operation. If the swashplate is tilted toward the cylinder block of the pump (not shown), the speed is increased. This causes the speed of the fixed swashplate within the transmission to increase, causing the hydraulic motor to run faster. This drives the axle and drive sprocket faster, causing that wheel to turn more quickly than its counterpart. By this action, turning in one direction or the other is achieved. If the swashplate of the two transmissions are inclined at the same angle, then the wheels will turn at the same speed. Thus, the car 10 will proceed in a straight path. Although many different models of hydrostatic drives are available, the preferred model is produced by Eaton Corporation of Cleveland, Ohio.

A wheel 88 is mounted to a hub (not shown) on each drive sprocket of the transaxle 62. The wheels 88 are the well-known tire with inner tubing, as are available from Powermaster Corp. of Taiwan.

The frame 66 is mounted over the hydrostatic drive 62 and the motor 64, as seen in FIG. 1, so that these parts are shielded during the use of the car 10 and the rider of the car 10 is protected from them. Suitable padding and coverings (not shown) are mounted upon the frame 66, so that a rider may comfortably be seated thereupon.

As seen in FIG. 1, a bumper 80 is deployed around the perimeter of the chassis 60. A tubing is deployed therein, having a valve 82 extending beyond the bumper 80. The tubing is inflated through the valve 82, such that the bumper may sustain the impacts encountered during driving.

Attached to the forward portion of the frame 66 are the joystick 68 and control unit 70. The joystick 68 is similar to that commonly known in the arcade machine arts, and is used by the rider to indicate which direction the car 10 is to be traveling. The preferred embodiment of the joystick 68 is that distributed by OEM Corporation of Shelton, Conn. It is envisioned that foot pedals could be used in place of a joystick, in a less-preferred embodiment.

The joystick 68 is in electrical communication with the control unit 70. The control unit 70 comprises a microprocessor board having control algorithms loaded therein. The control unit 70 interprets the signals transmitted thereto by the joystick 68 to determine what direction the car 10 is to be directed. The signals from the joystick 68 are then translated into physical actions. This is accomplished by the control unit 70 passing electrical signals to a pair of actuators 84, 84'. The control unit 70 indicates to the actuators 84, 84' what displacement is necessary for effecting the desired orientation of the car 10. The joystick 68 position also will indicate if motion is desired at all; thus, the actuators 84, 84' will allow or prevent translation of the power from the electrical motor 64 to the transaxle 62. Thus, the car 10 will only move when desired.

It is also possible for the car 10 to alter its orientation without movement. That is, the car 10 may pivot about its own transaxle 62 without moving either forwardly or rearwardly. This direction is indicated by positioning the joystick 68 either at a complete left position, to turn counterclockwise, or at a complete right position, to effect a clockwise rotation.

The body 72 of the car 10 is formed of a lightweight, yet durable plastic, fiberglass or a combination of these materials. Such composites are well known and widely available in the market. The body 72 serves to cover the internal components of the car while also adding a dimension of style to the car, depending upon the form into which it is made.

The movement of the car 10, thus, is precise and nearly instantaneous to the movements of the joystick 68. Stopping is achieved by release of the joystick 68 to a neutral position, such braking being heretofore unknown in the bumper car art. Also, the speed achieved is quickly the maximum speed once engagement of the joystick 68 is made. This is due to the quick response time of the hydrostatic drive and the quick instruction time of the control unit 70. Thus, the car 10 moves smoothly and quickly in response to the instructions received. Also, braking is now achievable. Therefore, rapid change of direction or orientation otherwise is now possible. This helps players to turn in response to the movement of the ball or the action on the floor, even by rotating on the axis of the car 10 itself. Such positioning would be advantageous when a defensive player has the desired location, but needs to turn toward shifting action. Such fluidity of motion and control has been unknown to the bumper car art and is a primary contribution to the art by the present invention.

It is to be noted that, in alternate embodiments, substitutions can be made for some elements of the car 10. It is envisioned that a less preferred embodiment of the transaxle 62 will replace the hydrostatic drive with a hydraulic drive. Although the response time of the hydraulic is not as crisp as that of the hydrostatic drive, it is a viable alternate embodiment. Additionally, an electric drive may also be selected as an alternate embodiment.

Also, it is envisioned that, to facilitate better play by the players, a foot pedal control system can be arranged to replace the joystick 68. The pedals can be depressed to allow for turning, as well as power. This would leave both hands free for the game itself.

Another envisioned alternate embodiment would be for the deployment of powered wheels at both the front and the back of the car. The wheels would be deployed such that lateral movement can be achieved.

Having thus described the invention, what is claimed is:

1. A bumper car for use in an amusement game played upon an electrified floor, the floor comprising a plurality of panels, each panel being of either a positive polarity or a negative polarity, the panels being deployed in alternating polarity, the car comprising:

(a) a chassis;

(b) means for drawing current from the floor;

(c) an electric motor receiving the current drawn from the floor to provide power for the car;

(d) a drive to translate the power received from the motor to wheels to drive and direct the car;

(e) a frame mounted upon the chassis;

(f) a joystick mounted upon the frame;

(g) a control unit in electrical communication with the joystick, the control unit being mounted upon the frame;

(h) a pair of actuators, the actuators being mounted upon the frame, the actuators being in communication with the control unit, the actuators being in communication with the drive, the control unit governing the drive through the actuators.

2. The car defined in claim 1, the means for drawing current comprising:

(a) a plurality of contacts mounted upon the car and concurrently in contact with the floor;

(b) a power rectifier in electrical communication with the contacts, the power rectifier converting the power from alternating current to direct current;

(c) a transformer receiving the direct current from the power rectifier, the transformer supply current to the control unit;

wherein the power rectifier supplies current to the electric motor and the transformer.

3. The car defined in claim 1, wherein the drive is a hydrostatic drive.

4. The car defined in claim 1, wherein the drive is a hydraulic drive.

5. The car defined in claim 1, wherein the drive is an electric drive.

6. The car defined in claim 1 further comprising a body mounted upon the frame.

7. The car defined in claim 1, the car further comprising:

a bumper deployed around the circumference of the chassis, the bumper comprising a tire and a tube disposed within the tire.

8. A bumper car for use in an amusement game played upon an electrified floor, the floor comprising a plurality of panels, each panel being of either a positive polarity or a negative polarity, the panels being deployed in alternating polarity, the car comprising:

(a) a chassis;

(b) a frame mounted upon the chassis;

(c) means for drawing current from the floor;

(d) an electric motor receiving the current drawn from the floor to provide power for the car;

(e) a drive to translate the power received from the motor to the wheels to drive and direct the car;

(f) a joystick forwardly centrally mounted upon the frame;

(g) a control unit in electrical communication with the joystick, the control unit being mounted upon the frame; and (h) a pair of actuators, the actuators being mounted upon the frame, the actuators being in electrical communication with the control unit, the actuators being in communication with the drive, the control unit governing the drive through the actuators.

9. The bumper car of claim 8 wherein the means for drawing current from the floor comprises:

(a) a pair of opposedly poled diodes mounted to the chassis; and (b) a plurality of contacts disposed on the chassis, the chassis being divided into quadrants, each one of the plurality of contacts being spaced equally in a corresponding quadrant amid the chassis and wherein each of the plurality of contacts is connected to the pair of opposedly poled diodes.

* * * * *